US008192282B2

(12) United States Patent
Kuwana

(10) Patent No.: US 8,192,282 B2
(45) Date of Patent: Jun. 5, 2012

(54) GAMING APPARATUS CHANGING SOUND ACCORDING TO IMAGE AND CONTROL METHOD THEREOF

(75) Inventor: Hiroyuki Kuwana, Tokyo (JP)

(73) Assignee: Universal Entertainment Corporation, Tokyo (JP)

( * ) Notice: Subject to any disclaimer, the term of this patent is extended or adjusted under 35 U.S.C. 154(b) by 443 days.

(21) Appl. No.: 12/389,002

(22) Filed: Feb. 19, 2009

(65) Prior Publication Data

US 2009/0233711 A1 Sep. 17, 2009

Related U.S. Application Data

(60) Provisional application No. 61/035,580, filed on Mar. 11, 2008.

(51) Int. Cl.
*A63F 9/24* (2006.01)

(52) U.S. Cl. ..... 463/31

(58) Field of Classification Search ..... 463/16–25, 463/31, 35, 43

See application file for complete search history.

(56) References Cited

U.S. PATENT DOCUMENTS

| | | | | |
|---|---|---|---|---|
| 2001/0014621 | A1* | 8/2001 | Okubo et al. | 463/35 |
| 2004/0072602 | A1* | 4/2004 | Toyoda | 463/10 |
| 2005/0097463 | A1* | 5/2005 | Yu | 715/531 |
| 2008/0126939 | A1* | 5/2008 | Chung et al. | 715/723 |

FOREIGN PATENT DOCUMENTS

WO 9726061 7/1997

* cited by examiner

*Primary Examiner* — Ha Tran T Nguyen
*Assistant Examiner* — Vongsavanh Sengdara
(74) *Attorney, Agent, or Firm* — Lexyoume IP Group, PLLC

(57) ABSTRACT

A gaming apparatus of the present invention comprises: a display; a speaker; a memory; and a controller programmed to execute the processing of reading the dealer image data and the game image data from the memory according to the progress of the game, reading the background image data from the memory, displaying to the display a display image based on display image data, after generating the display image data by superimposing the read dealer image data and the read game image data on the read background image data, and outputting from the speaker the background sound based on the background sound data, after reading the background sound data corresponding to the read background image data from the memory.

12 Claims, 16 Drawing Sheets

Fig. 1B

| Background effect | Background image data | Background sound data | Random number range | Content |
|---|---|---|---|---|
| Background effect A | Background image data A | Background sound data A | 0~17 | Passage of waiter (close) |
| Background effect B | Background image data B | Background sound data B | 18~35 | Passage of waiter (far) |
| Background effect C | Background image data C | Background sound data C | 36~53 | Passage of lady customer (close) |
| Background effect D | Background image data D | Background sound data D | 54~71 | Passage of lady customer (far) |
| Background effect E | Background image data E | Background sound data E | 72~89 | Passage of male customer (close) |
| Background effect F | Background image data F | Background sound data F | 90~107 | Passage of male customer (far) |

Fig. 11

| Background effect | Background image data | Background sound data | Selection condition | Content |
|---|---|---|---|---|
| Background effect A | Background image data A | Background sound data A | Dealer establishes One pair | Passage of waiter (close) |
| Background effect B | Background image data B | Background sound data B | Dealer establishes no hand | Passage of waiter (far) |
| Background effect C | Background image data C | Background sound data C | · | Passage of lady customer (close) |
| Background effect D | Background image data D | Background sound data D | · | Passage of lady customer (far) |
| Background effect E | Background image data E | Background sound data E | · | Passage of male customer (close) |
| Background effect F | Background image data F | Background sound data F | · | Passage of male customer (far) |

GAMING APPARATUS CHANGING SOUND ACCORDING TO IMAGE AND CONTROL METHOD THEREOF

CROSS-REFERENCE TO RELATED APPLICATIONS

This application claims priority of U.S. Provisional Application No. 61/035,580 filed on Mar. 11, 2008. The contents of this application are incorporated herein by reference in their entirety.

BACKGROUND OF THE INVENTION

1. Field of the Invention

The present invention relates to a gaming apparatus changing sound according to an image and a control method thereof.

2. Discussion of the Background

There has been conventionally known a gaming apparatus executing a video game such as blackjack and poker, as disclosed in WO 97/026061-A1. In a gaming apparatus of this kind, an image of a dealer is generally displayed to a display. Further, by displaying an image of the dealer executing game processing such as dealing of cards, the gaming apparatus is aimed to give a player a feeling of playing with a real dealer.

In a gaming apparatus of this kind, in addition to display of an image to a display, background music and an effect sound on dealing of cards are also outputted from a speaker according to the progress of a game.

However, there has been a problem that, even an image of the dealer is displayed, a game is poor in a sense of realism and is mechanical, in comparison with a game played in a real casino.

An object of the present invention is to provide a gaming apparatus capable of providing a player with a feeling as if the player is playing a game in a real casino, and a control method thereof.

The content of WO 97/026061-A1 is incorporated herein by reference in their entirety.

SUMMARY OF THE INVENTION

The present invention provides a gaming apparatus having the following configuration.

Namely, the gaming apparatus comprises: a display; a speaker; a memory storing dealer image data for displaying a dealer who advances a game, game image data relating to a progress of the game, and background image data corresponding to background sound data for outputting a background sound; and a controller. The controller is programmed to execute the processing of (A) advancing a game, (B) reading the dealer image data and the game image data from the memory, according to the progress of the game in the processing (A), (C) reading the background image data from the memory, (D) displaying to the display a display image based on display image data, after generating the display image data by superimposing the dealer image data and the game image data read in the processing (B) on the background image data read in the processing (C), and (E) outputting from the speaker the background sound based on the background sound data, after reading the background sound data corresponding to the background image data read in the processing (C) from the memory.

According to the gaming apparatus, dealer image data and game image data (for example, card image data) are read from a memory according to the progress of a game. Further, background image data is read from the memory. Then, the gaming apparatus displays to a display a display image based on display image data in which the dealer image data, the game image data, and the background image data are superimposed one another. On the other hand, a background sound corresponding to the read background image data is outputted from a speaker.

Accordingly, it is possible to output the background sound closely related to the background image. For example, in the case that the background image is an image of a waiter passing behind the dealer, a volume and echoes of footsteps can be changed in a case where the waiter passes close behind the dealer and in a case where the waiter passes far behind the dealer, resulting in making the game more realistic. Further, by displaying the background image not relating to the progress of the game directly, it is possible to provide a player with the stronger sense of realism that the player is playing the game in a casino.

Further, the gaming apparatus desirably comprises the following configuration.

The processing (C) is processing of reading a plurality of the background image data stored in the memory in a predetermined order.

According to the gaming apparatus, the background image is displayed by reading a plurality of background image data stored in the memory in a predetermined order. Accordingly, in the case that an audience is displayed as the background image, it is possible to provide a player with the stronger sense of realism by changing the size or the age group of the audience in accordance with the time.

Further, the gaming apparatus desirably comprises the following configuration.

The processing (C) is processing of reading the background image data corresponding to the progress of the game in the processing (A) from the memory.

According to the gaming apparatus, since the background image data corresponding to the progress of the game is read from the memory, it is possible to display the background image corresponding to the dealer's hand. Accordingly, the dealer's hand can be implied to the player, and thus, the background image can be related to the progress of the game, resulting in making the game more profound.

Furthermore, the gaming apparatus desirably comprises the following configuration.

Namely, the gaming apparatus comprises: a display; a speaker; a memory storing dealer image data for displaying a dealer who advances a game, game image data relating to a progress of the game, and background image data corresponding to background sound data for outputting a background sound; and a controller. The controller is programmed to execute the processing of (A) advancing a game, (B) reading the dealer image data and the game image data from the memory according to the progress of the game in the processing (A), (C) determining which background image data to read, out of a plurality of the background image data stored in the memory, (D) reading from the memory the background image data determined in the processing (C), and (E) displaying to the display a display image based on display image data, after generating the display image data by superimposing the dealer image data and the game image data read in the processing (B) on the background image data read in the processing (D), and (F) outputting from the speaker the background sound based on the background sound data, after reading the background sound data corresponding to the background image data read in the processing (D).

According to the gaming apparatus, dealer image data and game image data (for example, card image data) are read from a memory according to the progress of a game. Further, the gaming apparatus determines which background image data to read out of a plurality of the background image data, and reads the determined background image data from the memory. Then, the gaming apparatus displays to a display a display image based on display image data in which the dealer image data, the game image data, and the background image data are superimposed one another. On the other hand, a background sound corresponding to the read background image data is outputted from a speaker.

Accordingly, it is possible to output the background sound closely related to the background image. For example, in the case that the background image is an image of a waiter passing behind the dealer, a volume and echoes of footsteps can be changed in a case where the waiter passes close behind the dealer and in a case where the waiter passes far behind the dealer, resulting in making the game more realistic. Further, by displaying the background image not relating to the progress of the game directly, it is possible to provide a player with the stronger sense of realism that the player is playing the game in a casino.

Particularly, since the gaming apparatus determines which background image data is to be read out of the plurality of the background image data, it is possible to provide randomness to the background image to be displayed, resulting in providing the player with the stronger sense of realism.

Moreover, the gaming apparatus desirably comprises the following configuration.

Namely, the gaming apparatus comprises: a display; a speaker; an image storage memory storing three-dimensional image data for generating a three-dimensional image by arranging in a world coordinate space a dealer object showing a dealer who advances a game, a game object relating to a progress of the game, and a background object showing a background, the background object being corresponding to background sound data for outputting a background sound, and a controller. The controller is programmed to execute the processing of (A) advancing a game, (B) arranging the dealer object and the game object in the world coordinate space, concurrently with determining shapes of the dealer object and the game object, according to the progress of the game in the processing (A), (C) arranging the background object in the world coordinate space, concurrently with determining a shape of the background object, (D) displaying to the display a display image based on three-dimensional display image data, after generating the three-dimensional display image data based on the dealer object and the game object arranged in the world coordinate space in the processing (B) and on the background object arranged in the processing (C), (E) determining volume of sound to be outputted, based on a position coordinate of the background object arranged in the world coordinate space in the processing (C), and (F) outputting from the speaker the background sound based on the background sound data at the volume determined in the processing (E).

According to the gaming apparatus, shapes of a dealer object and a game object are determined and the dealer object and the game object are arranged in the world coordinate space, according to the progress of the game. Then, a three-dimensional display image is generated based on the dealer object and the game object arranged in the world coordinate space and on the background object. Thereafter, a display image based on the produced image display data is displayed to the display. On the other hand, a volume of the sound to be outputted is determined based on a position coordinate of the background object arranged in the world coordinate space, and a background sound at the determined volume is outputted.

Accordingly, it is possible to make the volume of the background sound related to the position of the background object. For example, in the case that the background object is an object showing a waiter, a volume and echoes of footsteps can be changed in a case where the waiter passes close behind the dealer and in a case where the waiter passes far behind the dealer, resulting in making the game more realistic. Further, by displaying the background image not relating to the progress of the game directly, it is possible to provide a player with the stronger sense of realism that the player is playing the game in a casino.

The present invention further provides a control method of a gaming apparatus having the following configuration.

Namely, the control method of a gaming apparatus comprises the steps of: (A) advancing a game, (B) reading dealer image data for displaying a dealer who advances a game and game image data relating to a progress of the game from a memory, according to the progress of the game in the step (A), (C) reading background image data from the memory, (D) displaying to a display a display image based on display image data, after generating the display image data by superimposing the dealer image data and the game image data read in the step (B) on the background image data read in the step (C), and (E) outputting from a speaker a background sound based on background sound data, after reading the background sound data corresponding to the background image data read in the step (C) from the memory.

According to the control method of a gaming apparatus, dealer image data and game image data (for example, card image data) are read from a memory according to the progress of a game. Further, background image data is read from the memory. Then, the gaming apparatus displays to a display a display image based on display image data in which the dealer image data, the game image data, and the background image data are superimposed one another. On the other hand, a background sound corresponding to the read background image data is outputted from a speaker.

Accordingly, it is possible to output the background sound closely related to the background image. For example, in the case that the background image is an image of a waiter passing behind the dealer, a volume and echoes of footsteps can be changed in a case where the waiter passes close behind the dealer and in a case where the waiter passes far behind the dealer, resulting in making the game more realistic. Further, by displaying the background image not relating to the progress of the game directly, it is possible to provide a player with the stronger sense of realism that the player is playing the game in a casino.

The present invention further provides a control method of a gaming apparatus having the following configuration.

Namely, the control method of a gaming apparatus comprises the steps of: (A) advancing a game, (B) reading dealer image data for displaying a dealer who advances a game and game image data relating to a progress of the game from a memory, according to the progress of the game in the step (A), (C) determining which background image data to read, out of a plurality of background image data stored in the memory, (D) reading from the memory the background image data determined in the step (C), and (E) displaying to a display a display image based on display image data, after generating the display image data by superimposing the dealer image data and the game image data read in the step (B) on the background image data read in the step (D), and (F) outputting from a speaker a background sound based on background sound data, after reading the background sound data corresponding to the background image data read in the step (D).

According to the control method of the gaming apparatus, dealer image data and game image data (for example, card image data) are read from a memory according to the progress of a game. Further, the gaming apparatus determines which background image data to read out of a plurality of the background image data, and reads the determined background image data from the memory. Then, the gaming apparatus displays to a display a display image based on display image data in which the dealer image data, the game image data, and the background image data are superimposed one another. On the other hand, a background sound corresponding to the read background image data is outputted from a speaker.

Accordingly, it is possible to output the background sound closely related to the background image. For example, in the case that the background image is an image of a waiter passing behind the dealer, a volume and echoes of footsteps can be changed in a case where the waiter passes close behind the dealer and in a case where the waiter passes far behind the dealer, resulting in making the game more realistic. Further, by displaying the background image not relating to the progress of the game directly, it is possible to provide a player with the stronger sense of realism that the player is playing the game in a casino.

Particularly, since the gaming apparatus determines which background image data to read out of the plurality of the background image data, it is possible to provide randomness to the background image to be displayed, resulting in providing the player with the stronger sense of realism.

BRIEF DESCRIPTION OF THE DRAWINGS

FIG. 1B is a view illustrating a background effect determination table.

FIG. 11 is a view illustrating a background effect determination table according to another embodiment of the present invention.

DESCRIPTION OF THE EMBODIMENTS

There will be described an embodiment of the present invention with reference to the drawings.

In the following embodiment, there will be described a case where Pai-Gow poker is played in a gaming apparatus. Here, a rule of Pai-Gow poker will be described later.

Figure 1A:
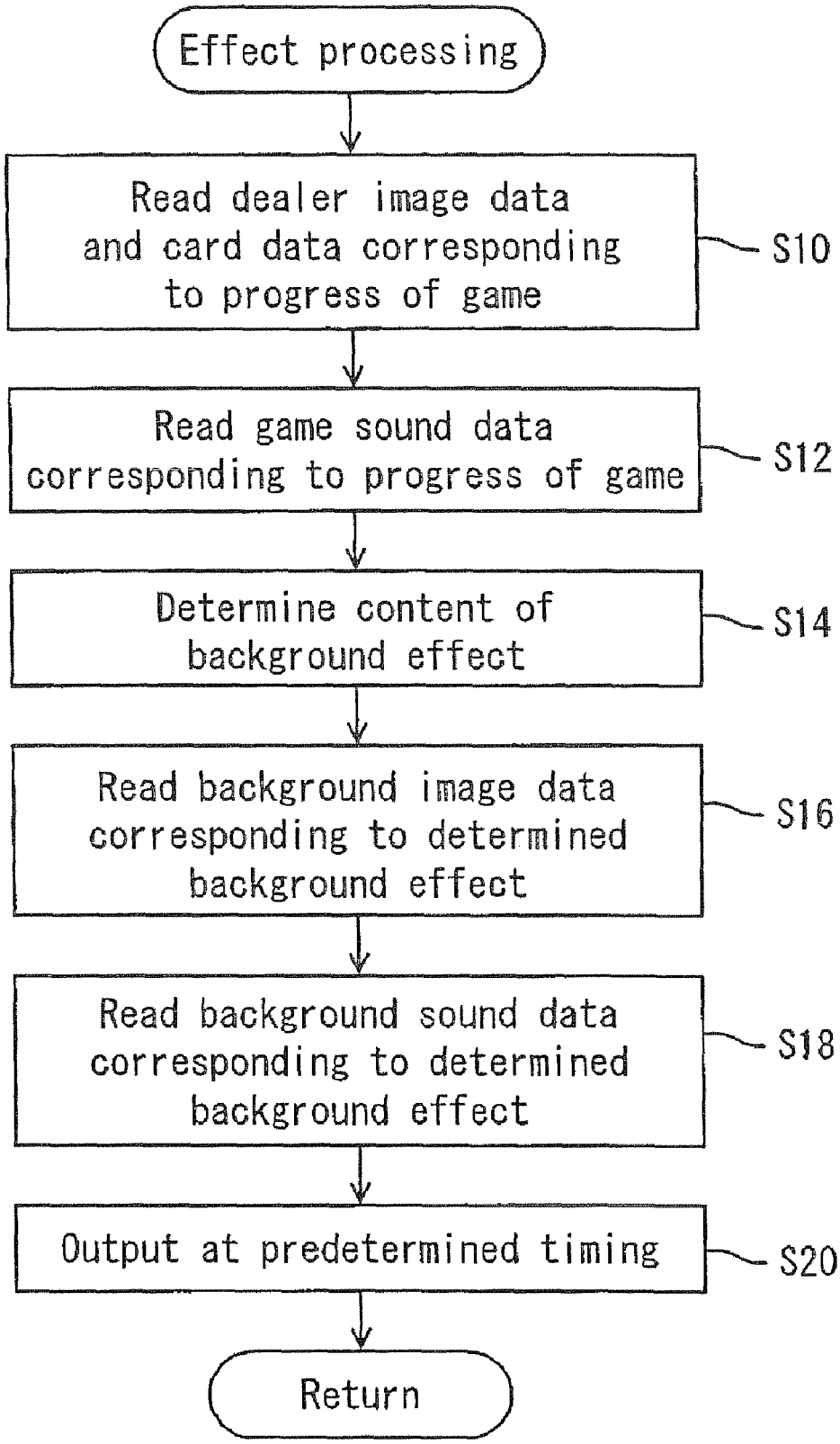
FIG. 1A is a flow chart illustrating main-control-portion-side processing executed in a main control portion included in a gaming apparatus according to one embodiment of the present invention.

FIG. 1A is a flow chart illustrating main-control-portion-side processing executed in a main control portion included in a gaming apparatus according to one embodiment of the present invention.

First, there will be described an effect processing executed by a main control portion 40 included in a gaming apparatus 1 according to an embodiment of the present invention.

A CPU 41 included in the main control portion 40 produces an effect, while advancing a game, by displaying an image to a front display 21 (see FIG. 2) or outputting a sound from speakers 22 (see FIG. 2) according to a progress of the game. Namely, while executing game processing according to the progress of the game, the CPU 41 executes the effect processing by executing interrupt processing at a predetermined timing. Here, there will be described the effect processing with reference to FIG. 1A, and the game processing will be described later with reference to FIG. 8 and FIG. 9.

First, in step S10 in FIG. 1A, the CPU 41 reads, while advancing a game, dealer image data and card image data according to the progress of the game from ROM 43. For example, in the case that a to-be-dealt card is determined (see step S103 in FIG. 8), the CPU 41 reads the dealer image data indicating a dealer dealing cards. Further, for example, in the case of opening cards (see step S107 in FIG. 8), the CPU 41 reads the card image data corresponding to each card, in addition to showing the image indicating the dealer turning up the cards displayed facing down. Here, the card image data is included in the game image data of the present invention.

Next, in step S12, the CPU 41 reads game sound data corresponding to the progress of the game from the ROM 43. For example, in the case of opening the cards (see step S107 in FIG. 8), the CPU 41 reads from the ROM 43 the game sound data according to an effect sound at turning up the cards.

Then, the CPU 41 determines a content of a background effect (step S14).

FIG. 1B is a view illustrating a background effect determination table.

As illustrated in FIG. 1B, background image data corresponds to background sound data respectively as background effects A to F. Further, random number ranges are respectively set to the background effects. Here, in the background effect determination table, a content of the effect is also written.

For example, when the background sound data (background sound data A) for an effect that a waiter passes close behind a dealer (background effect A) is compared with the background sound data (background sound data B) for an effect that a waiter passes far behind a dealer (background effect B), footsteps of the waiter in the background sound data A is set to be outputted louder than footsteps of the waiter in the background sound data B. Further, echoes of the footsteps of the waiter in the background sound data A is set to be outputted smaller than echoes of the footsteps of the waiter in the background sound data B. Here, an echo effect can be set as appropriate according to a space of the casino shown by a casino image as another background image.

In step S14, so as to determine a background effect, the CPU 41 selects a random number out of a numerical range from 0 to 107 by executing a random number generating program included in the game program. In the present embodiment, there will be described a case where a random number is generated on a program (so-called software random number). However, in the present invention, a random number generator may be provided so that the random number is extracted therefrom (so-called hardware random number).

In step S16, the CPU 41 reads background image data corresponding to the background effect determined in step S14, and generates display image data by superimposing the dealer image data and the card image data read in step S10 on the read background image data. Here, on superimposing the image data, respective image data are superimposed so that the back-side data is set behind the front-side data.

In step S18, the CPU 41 reads background sound data corresponding to the background effect determined in step S14.

In step S20, the CPU 41 outputs a sound based on sound data (game sound data and the background sound data) from the speakers 22, in addition to displaying to the front display 21 a display image based on the display image data at each predetermined timing (for example, every 1/30 of a second).

According to the gaming apparatus 1, the dealer image data and the card image data as the game image data are read from the ROM 43 according to the progress of the game. Further, the gaming apparatus 1 determines which background image data to read out of a plurality of the background image data, and reads the determined background image data from the ROM 43. Then, the display image based on display image data in which the dealer image data, the game image data, and the background image data are superimposed one another, is displayed to the front display 21. On the other hand, a background sound corresponding to the read background image data is outputted from the speakers 22.

Accordingly, in the case of displaying the background image of the waiter passing close behind the dealer, footsteps can be set louder compared to a case of displaying the background image of the waiter passing far behind the dealer. As a result, it is possible to make the game more realistic. Further, by displaying the background image not relating to the progress of the game directly, it is possible to provide a player with the stronger sense of realism that the player is playing the game in a casino.

Particularly, since the gaming apparatus 1 determines which background image data to read out of the plurality of the background image data, it is possible to provide randomness to the background image to be displayed, resulting in providing the player with the stronger sense of realism.

Here, the rule of Pai-Gow poker will be described.

In Pai-Gow porker, a banker and a single player or a plurality of players play a game against each other, using a single set of playing cards (53 cards) including a single joker.

At first, 7 cards are respectively dealt to the banker and the players. The banker and the players divide their dealt seven cards into a set of five cards and a set of two cards. At this time, the hand of five cards (a high hand) must be as strong as the hand of two cards (the low hand) or stronger than the hand of two cards. Next, the banker's hand of five cards is compared with the player's hand of five cards to determine which of them is stronger than the other. Similarly, the banker's hand of two cards is compared with the player's hand of two cards to determine which of them is stronger than the other. When both the banker's hands of five cards and two cards are stronger than those of the player's, the game results in winning of the banker. When both the player's hands of five cards and two cards are stronger than those of the banker's, the game results in winning of the player. When one player's hand, out of the hands of five cards and two cards, is stronger than the banker's corresponding hand and the other banker's hand is stronger than the player's corresponding hand, the game is tied. Also, when both the player's hands of five cards and two cards are as strong as the banker's corresponding hands, the game results in winning of the banker. Further, as hands of five cards, there are Royal Flush, Straight Flush, Four of a Kind, Full House, Flush, Straight, Three of a Kind, Two pair, One pair and No Pair, in the order of strength. As hands of two cards, there are One Pair and No Pair, in the order of strength.

Next, there will be described the gaming apparatus 1 according to the present embodiment.

Figure 2:
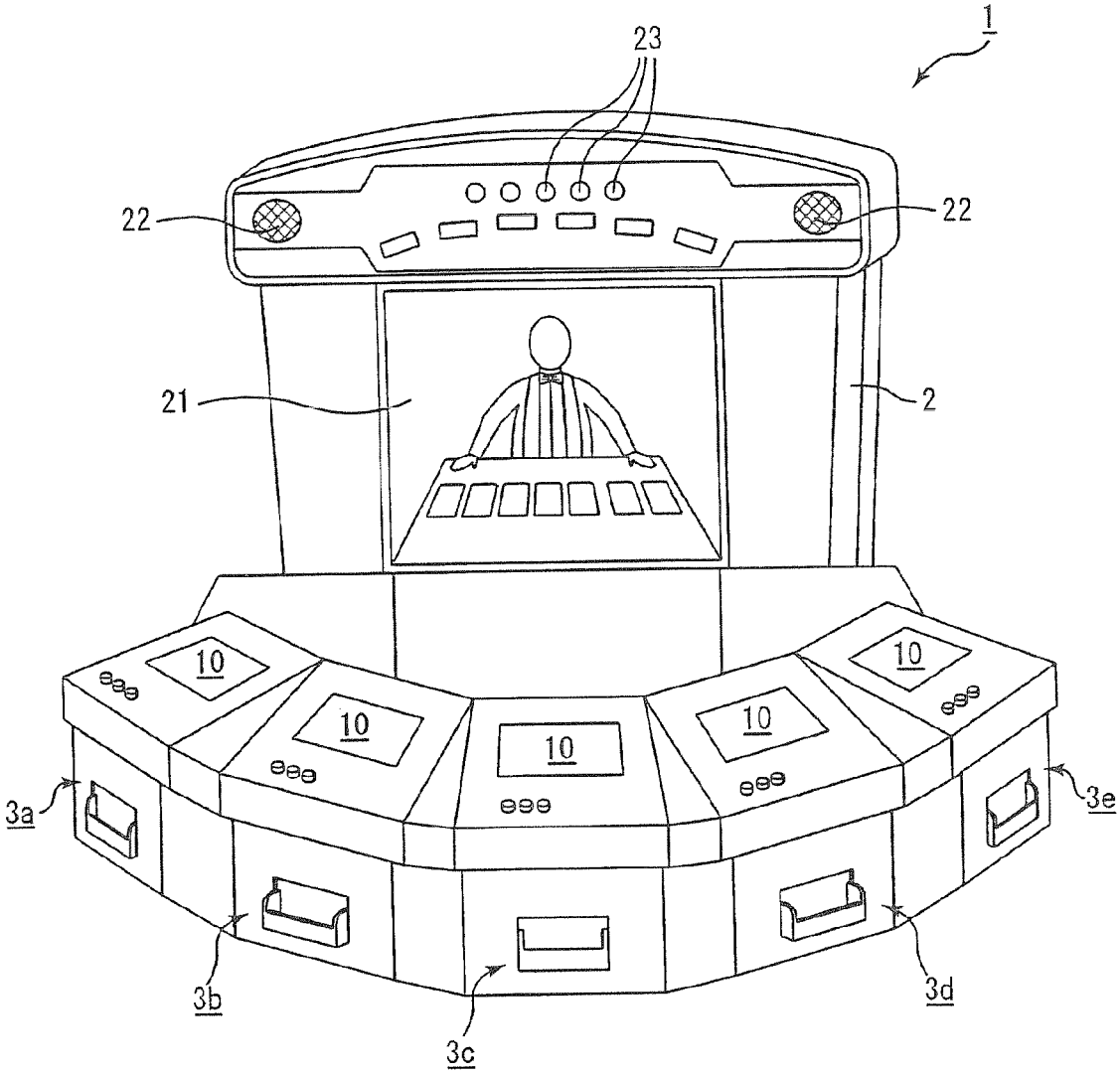
FIG. 2 is a perspective view schematically illustrating the external structure of the gaming apparatus according to one embodiment of the present invention.

FIG. 2 is a perspective view schematically illustrating the external structure of the gaming apparatus according to one embodiment of the present invention.

As illustrated in FIG. 2, the gaming apparatus 1 basically comprises a main monitor 2 and five stations 3 (stations 3*a* to 3*e*). Further, in the present embodiment, while there will be described a case where the gaming apparatus 1 comprises a plurality of (five) stations 3, the number of stations included in a gaming apparatus may be one in the present invention.

At the center portion of the main monitor 2, there is provided a front display 21 for displaying images indicating a dealer and cards. The front display 21 corresponds to a display according to the present invention. Further, on the upper side of the main monitor 2, there are provided a plurality of speakers 22 for outputting music and an effect sound along with the progress of a game executed in the gaming apparatus 1 and a plurality of LEDs 23 which are lighted during various types of effects. The speakers 22 correspond to a speaker according to the present invention.

Figure 3:
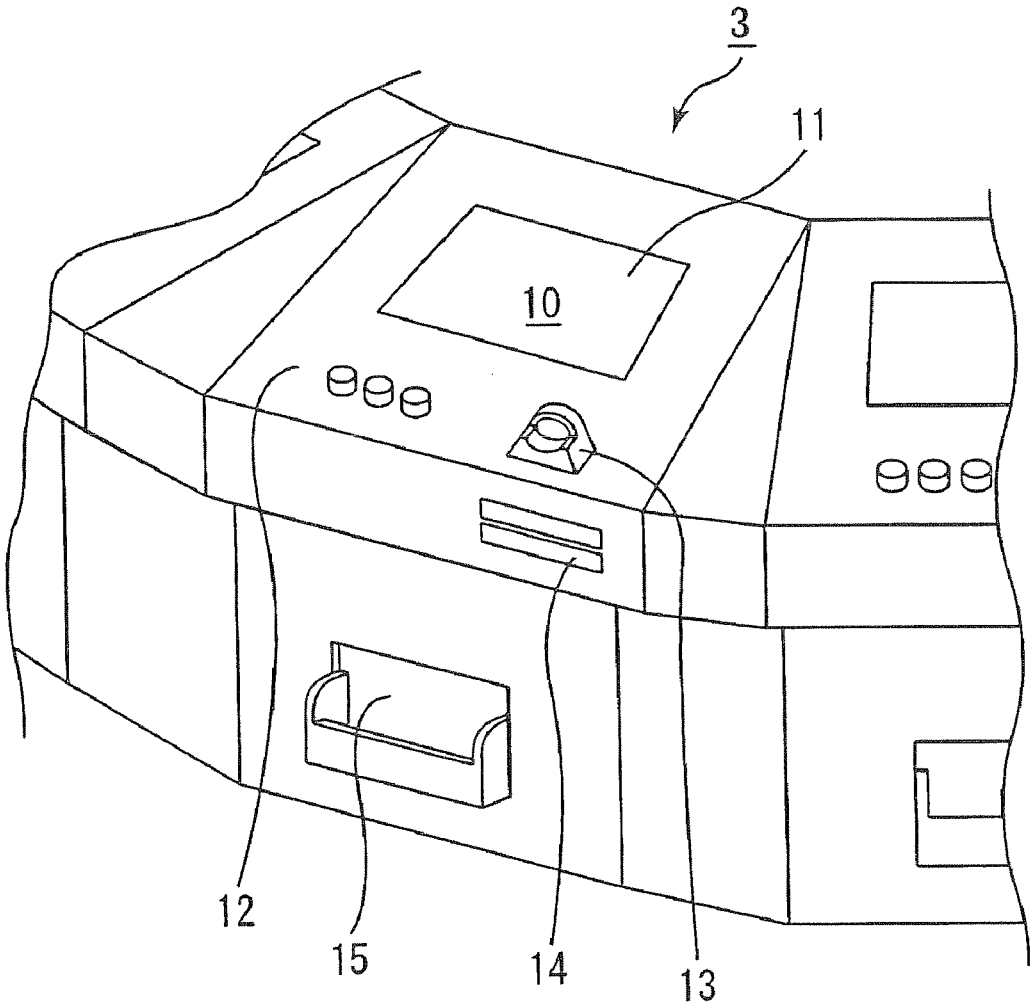
FIG. 3 is a perspective view schematically illustrating the external structure of a station included in the gaming apparatus illustrated in FIG. 2.

FIG. 3 is a perspective view schematically illustrating the external structure of a station included in the gaming apparatus illustrated in FIG. 2.

As illustrated in FIG. 3, at the center of the upper surface of the station 3, there is provided a liquid crystal display 10 for displaying an image relating to an operation (see FIG. 5) and the like as will be described later. Further, on the upper surface of the liquid crystal display 10, there is provided a touch panel 11 for inputting an operation for a BET and the like.

In front of the liquid crystal display 10, there are provided a plurality of operation buttons 12 for performing a payout operation, and a coin insertion slot 13 for inserting a coin or a medal thereto.

At the upper right end of the front surface of the station 3, there is provided a bill insertion slot 14 for inserting a bill thereto. Below the bill insertion slot 14, there is provided a coin payout exit 15 for paying out the number of coins or medals corresponding to the accumulated credit to the player, when a payout operation is performed.

Figure 4A:
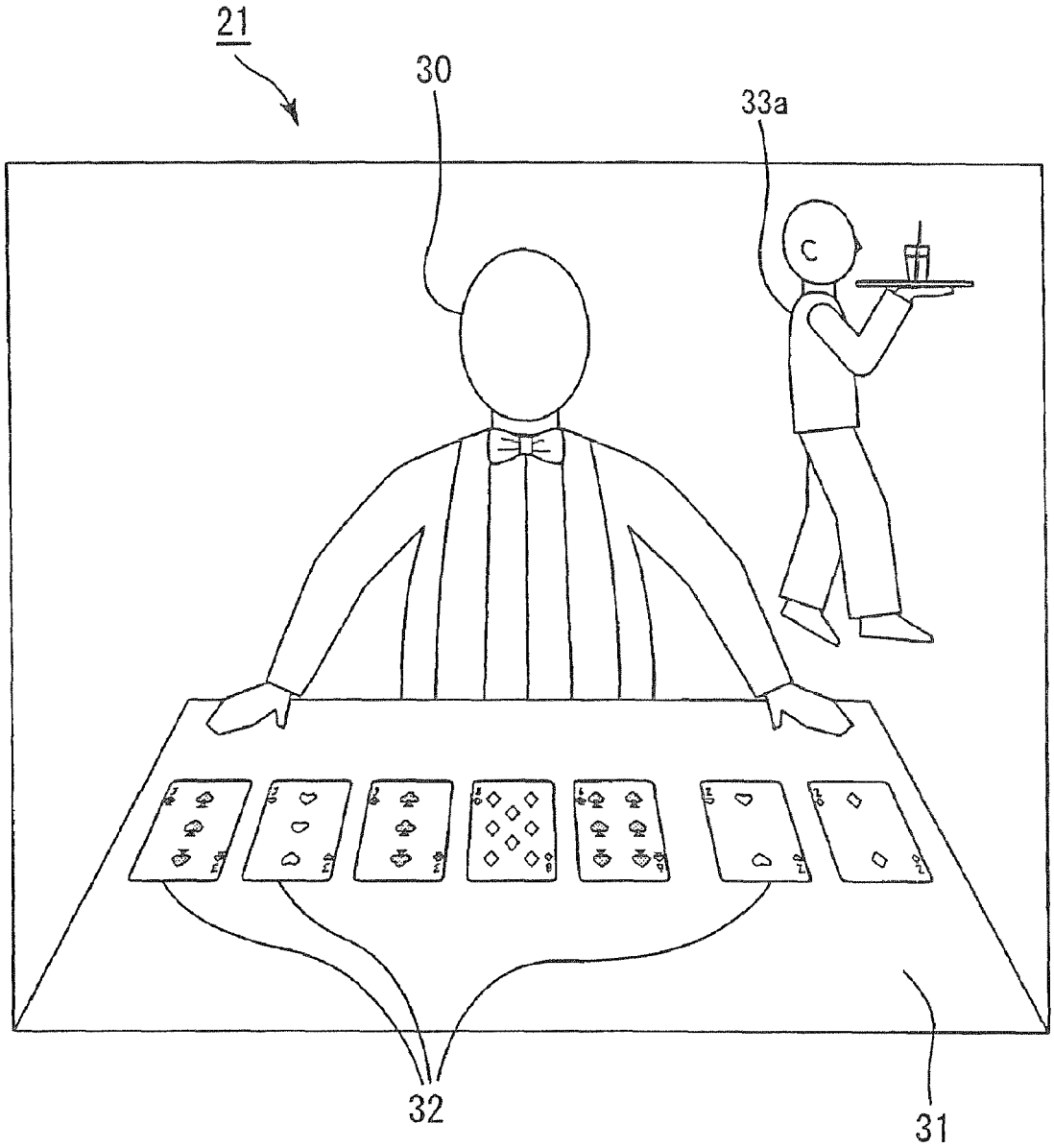
FIG. 4A is a view illustrating an exemplary image which is displayed to a front display included in the gaming apparatus illustrated in FIG. 2.
Figure 4B:
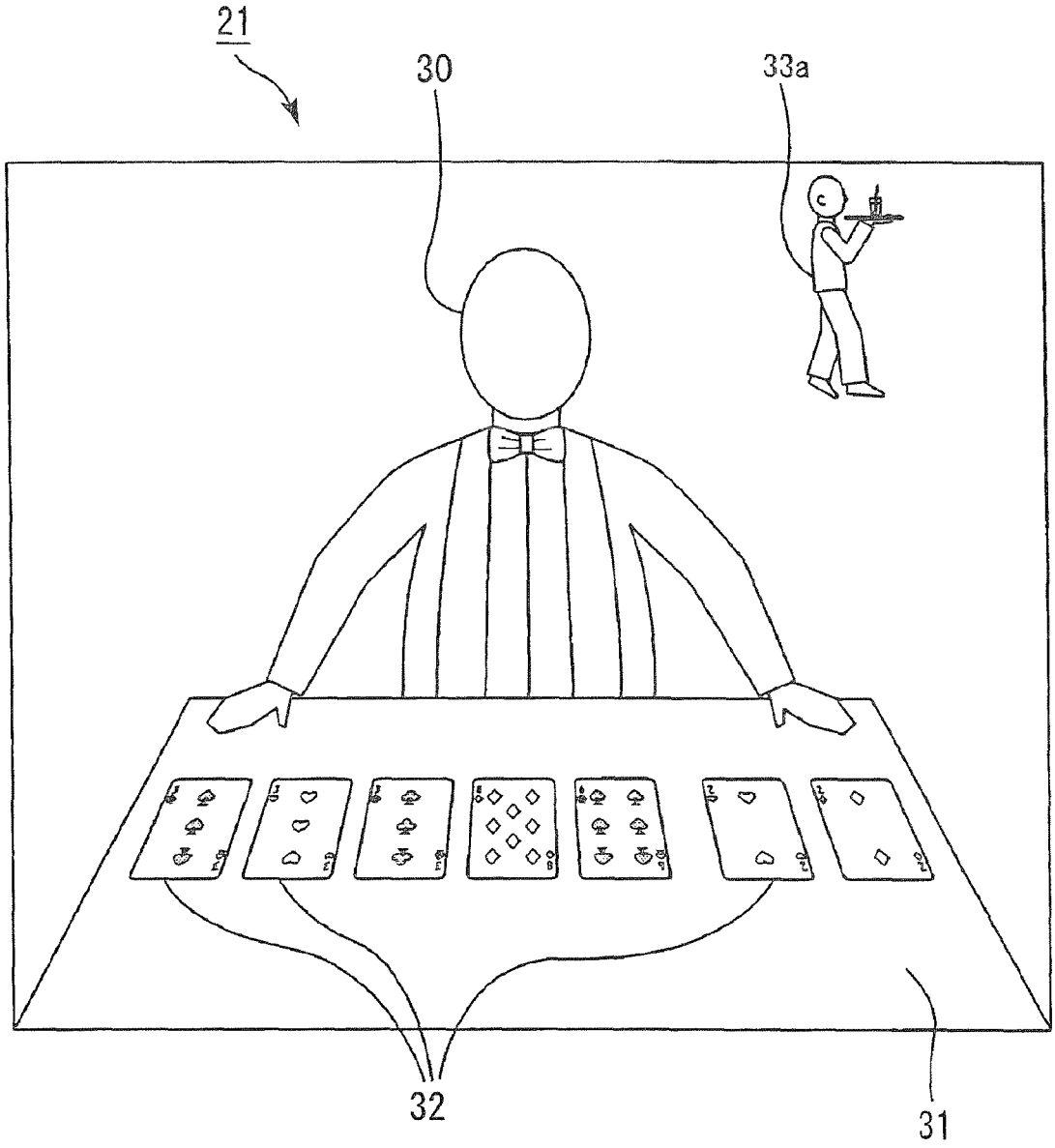
FIG. 4B is another view illustrating an exemplary image which is displayed to a front display included in the gaming apparatus illustrated in FIG. 2.

FIG. 4A and FIG. 4B are views each illustrating an exemplary image which is displayed to the front display included in a gaming apparatus illustrated in FIG. 2.

As illustrated in FIG. 4A, the front display 21 displays a dealer image 30 indicating a dealer (banker), a table image 31 indicating a table, and card images 32 indicating seven banker's cards. The card images 32 are displayed facing down, when cards are dealt to the dealer. When the high hand and the low hand are determined, the card images 32 are displayed facing up. The five cards on the observer's left side in FIG. 4A indicate the high hand, while the two cards on the right side indicate the low hand.

Further, to the front display 21 illustrated in FIG. 4A, a waiter image 33*a* is displayed. The waiter image 33*a* is an image displayed when a background effect A is selected and an image corresponding to the background image data A.

On the other hand, to the front display 21 illustrated in FIG. 4B, a waiter image 33*b* is displayed. The waiter image 33*b* is an image displayed when a background effect B is selected and an image corresponding to the background image data B.

When the background effect A is selected, a background sound based on the background sound data A is outputted. Further, when the background effect B is selected, a background sound based on the background sound data B is outputted.

Here, footsteps of the waiter in the background sound data A is set to be outputted louder than footsteps of the waiter in the background sound data B. Further, echoes of the footsteps of the waiter in the background sound data A is set to be outputted smaller than echoes of the footsteps of the waiter in the background sound data B.

Figure 5:
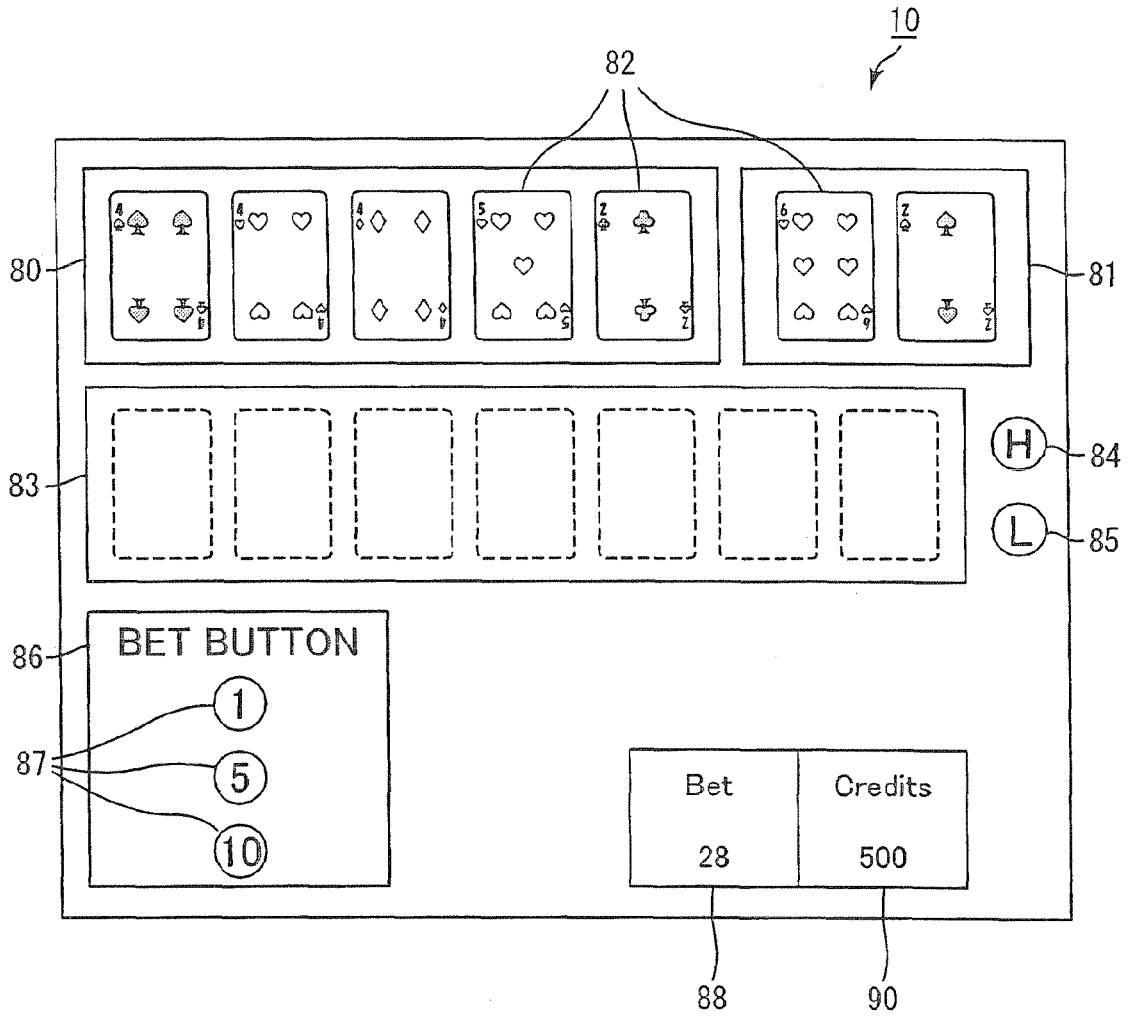
FIG. 5 is a view illustrating an exemplary image which is displayed to a liquid crystal display included in a station.

FIG. 5 is a view illustrating an exemplary image which is displayed to a liquid crystal display included in a station.

As illustrated in FIG. 5, at an upper portion of the liquid crystal display 10, there are provided a high-hand display portion 80 for displaying the player's high hand and a low-hand display portion 81 for displaying the player's low hand. To the high-hand display portion 80 and the low-hand display portion 81, there are respectively displayed card images 82 indicating the cards of the high hand and the cards of the low hand, with their faces up. Under the high-hand display portion 80, there is provided a dealt-card display portion 83. To the seven dotted boxes in the dealt-card display portion 83, card images indicating the seven player's cards dealt to the player are displayed with their faces up. On the right side of the dealt-card display portion 83, there are provided a high-hand determination button 84 and a low-hand determination button 85 for determining the cards included in the high hand and the low hand. The player can determine a high hand by selecting cards that he or she desires to have in the high hand, out of the cards displayed to the dealt-card display portion 83, through the touch panel 11 and operating the high-hand determination button 84 through the touch panel 11. The cards determined to be included in the high hand are displayed to the high-hand display portion 80. Similarly, the player can determine a low hand by selecting cards that he or she desires to have in the low hand, out of the cards displayed to the dealt-card display portion 83, through the touch panel 11 and operating the low-hand determination button 85 through the touch panel 11.

Under the dealt-card display portion 83, there is provided a BET button display portion 86. To the BET button display portion 86, there are displayed BET buttons 87 for inputting the number of BETs. The player can input the number of BETs by operating the BET buttons 87 through the touch panel 11.

At the right side of the BET button display portion 86, there is provided a number-of-BETs display portion 88 for displaying the number of BET coins. FIG. 5 illustrates that 28 coins are BET. Further, in order to input a BET of 28 coins, the player can operate a "10" BET button 87 twice, "5" BET button 87 once and a "1" BET button 87 three times.

At the right side of the number-of-BETs display portion 88, there is provided the number-of-credits display portion 90. FIG. 5 illustrates that 500 coins are being credited.

Figure 6:
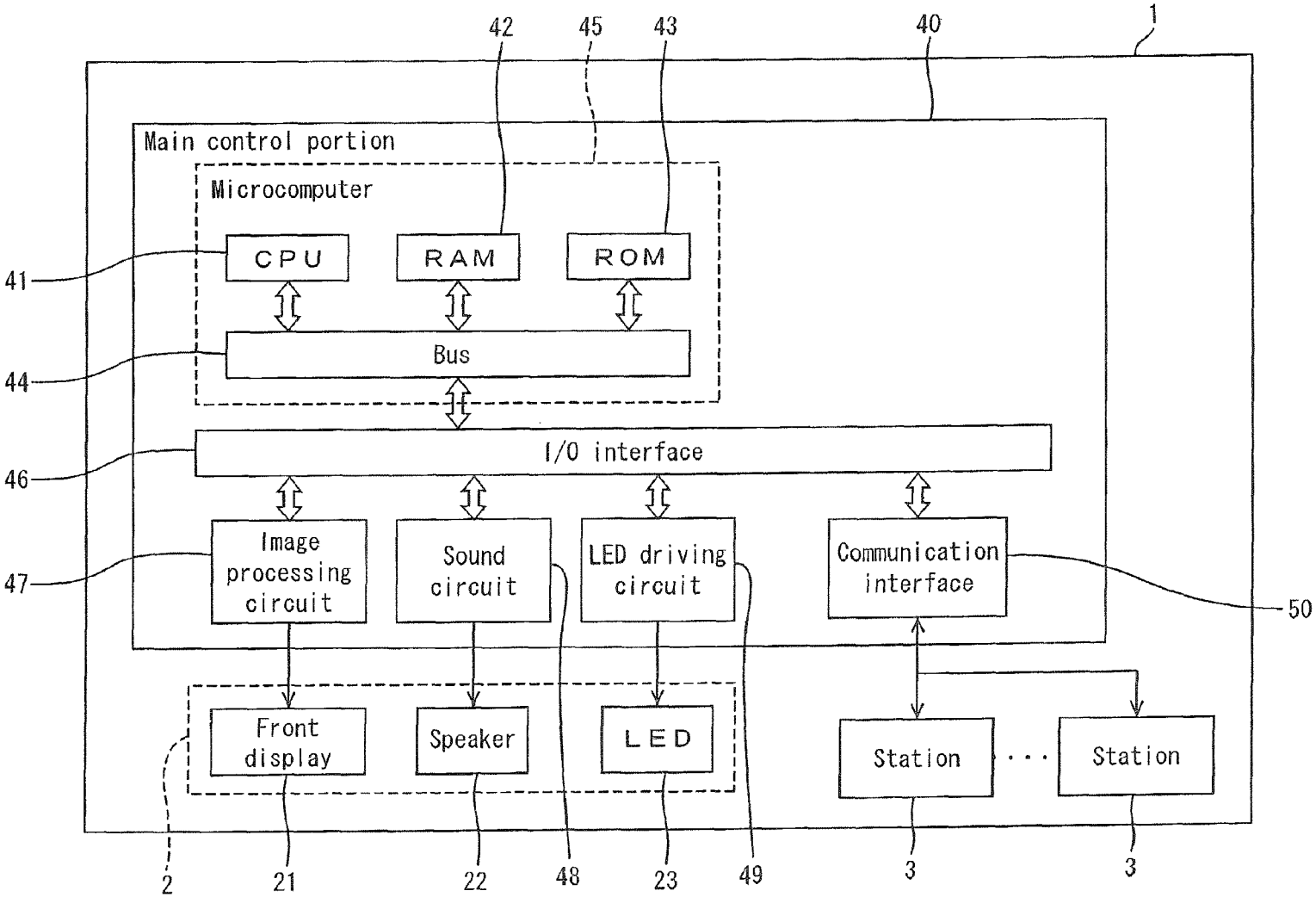
FIG. 6 is a block diagram illustrating the internal structure of the gaming apparatus illustrated in FIG. 2.

FIG. 6 is a block diagram illustrating the internal structure of the gaming apparatus illustrated in FIG. 2.

As illustrated in FIG. 6, the main control portion 40 provided in the gaming apparatus 1 comprises a microcomputer 45 as a core, which basically includes the CPU 41, the RAM 42, the ROM 43, and a bus 44 for transferring data mutually among these devices. The main control portion 40 corresponds to a controller according to the present invention.

The ROM 43 stores various types of programs for executing processing necessary for controlling the gaming apparatus 1, a data table and the like. The various types of programs include, for example, a game program relating to the progress of the game. Further, examples of data tables include the background effect determination table. Furthermore, the ROM 43 stores background image data and background sound data.

The RAM 42 is a memory for temporarily storing various types of data calculated in the CPU 41.

Further, the CPU 41 is connected to an image processing circuit 47, a sound circuit 48, an LED driving circuit 49 and a communication interface 50 through an I/O interface 46.

The front display 21 included in the main monitor 2 is connected to the image processing circuit 47. The speakers 22 included in the main monitor 2 are connected to the sound circuit 48. The LEDs 23 included in the main monitor 2 are connected to the LED driving circuit 49. The five stations 3 are connected to the communication interface 50.

The CPU 41 advances a game executed in the gaming apparatus 1, based on the game program stored in the ROM 43 and various types of signals received from the stations 3.

Further, the CPU 41 displays an image to the front display 21, outputs sound from the speakers 22 and lights the LEDs 23, based on the above-mentioned game program. Further, the CPU 41 transmits various types of signals to the respective stations 3, based on the above-mentioned game program.

Figure 7:
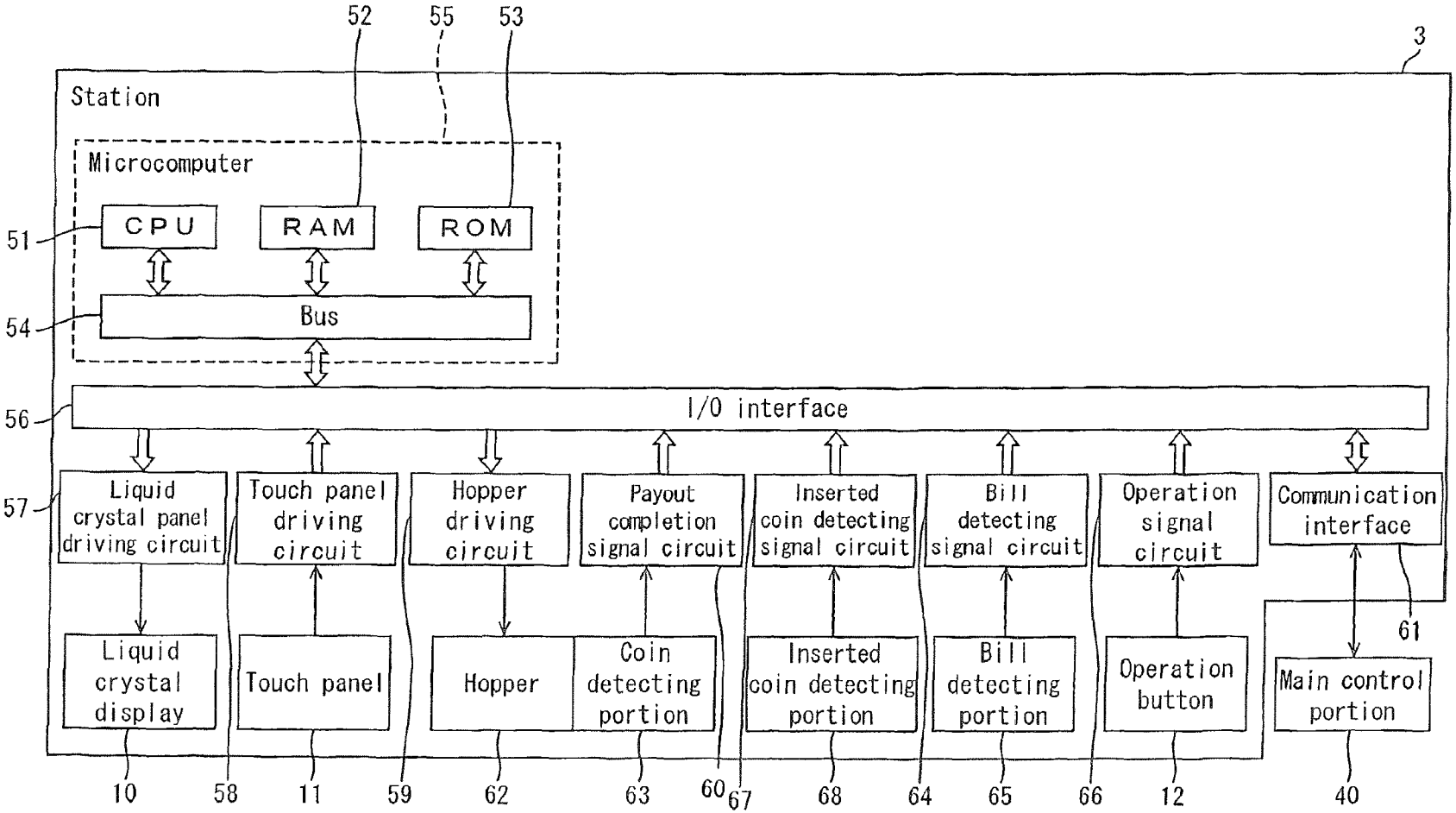
FIG. 7 is a block diagram illustrating the internal structure of a station included in the gaming apparatus illustrated in FIG. 2.

FIG. 7 is a block diagram illustrating the internal structure of a station included in the gaming apparatus illustrated in FIG. 2.

As illustrated in FIG. 7, the station 3 comprises, as a core, a microcomputer 55 which is basically includes a CPU 51, a RAM 52, a ROM 53, and a bus 54 for transferring data mutually among these devices.

The ROM 53 stores various types of programs for executing processing necessary for controlling the station 3, a data table and the like. Further, the RAM 52 temporarily stores the number of credits currently accumulated in the station 3 and various types of data calculated in the CPU 51.

Further, the CPU 51 is connected to a liquid crystal panel driving circuit 57, a touch panel driving circuit 58, a hopper driving circuit 59, a payout completion signal circuit 60, an inserted-coin detecting signal circuit 67, a bill detecting signal circuit 64, an operation signal circuit 66 and a communication interface 61, through an I/O interface 56.

A liquid crystal display 10 is connected to the liquid crystal panel driving circuit 57. A touch panel 11 is connected to the touch panel driving circuit 58. A hopper 62 is connected to the hopper driving circuit 59. A coin detecting portion 63 is connected to the payout completion signal circuit 60. An inserted-coin detecting portion 68 is connected to the inserted-coin detecting signal circuit 67. A bill detecting portion 65 is connected to the bill detecting signal circuit 64. An operation button 12 is connected to the operation signal circuit 66.

The hopper 62 is provided inside the station 3 and pays out a coin through the coin payout exit 15 based on a control signal outputted from the CPU 51.

The coin detecting portion 63 is provided inside the coin payout exit 15 and transmits a signal to the CPU 51 on detecting a predetermined number of coins being paid out through the coin payout exit 15.

The inserted-coin detecting portion 68, on detecting a coin being inserted from the coin insertion slot 13, detects the value of the coin and transmits a detecting signal indicative of the detected value to the CPU 51. The detected value of the coin is counted regarding a predetermined value defined as 1 credit and is stored in the RAM 52.

The bill detecting portion 65, on accepting a bill, detects the value of the bill and transmits a detecting signal indicative of the detected value to the CPU 51. The detected value of the bill is counted regarding a predetermined value defined as 1 credit and is stored in the RAM 52.

The operation button 12 is a button for performing payout operations, when payout of the coin is determined.

Next, there will be described processing executed in the main control portion 40 and the station 3.

First, there will be described game processing executed in the main control portion 40.

Figure 8:
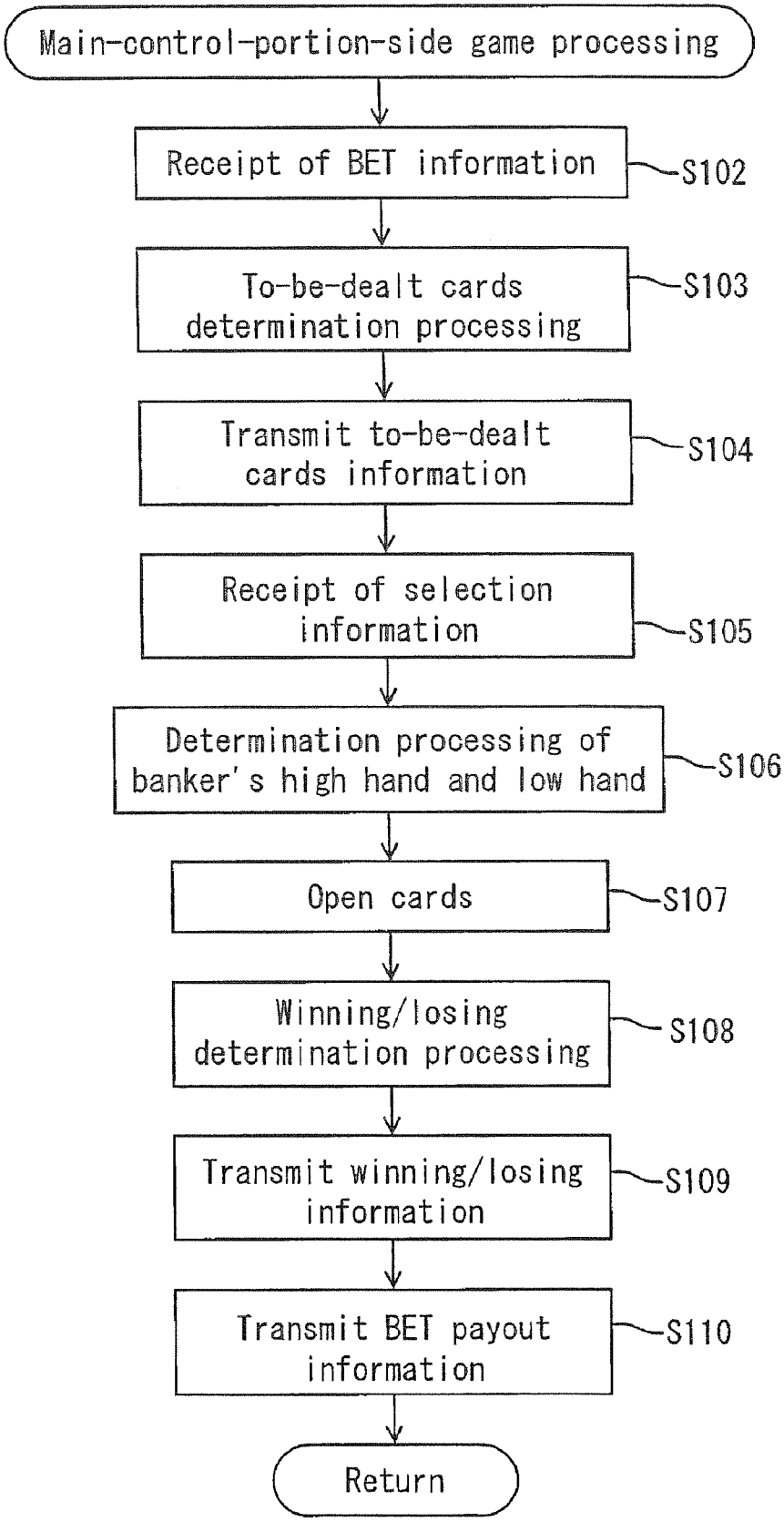
FIG. 8 is a flow chart illustrating a subroutine of main-control-portion-side game processing executed in a main control portion included in the gaming apparatus according to the present embodiment.

FIG. 8 is a flow chart illustrating a subroutine of main-control-portion-side game processing executed in a main control portion included in the gaming apparatus according to the present embodiment.

Figure 9:
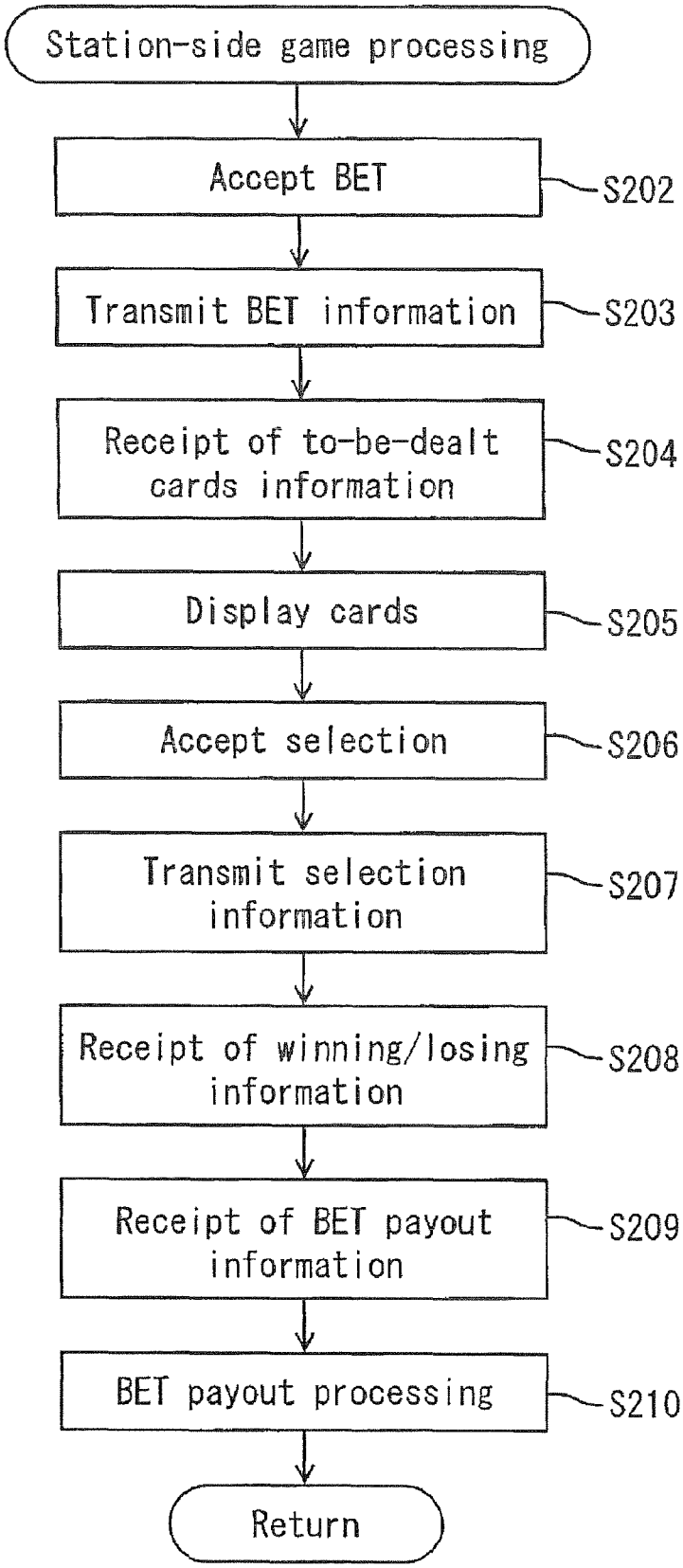
FIG. 9 is a flow chart illustrating a subroutine of station-side game processing executed in the station according to the present embodiment.

First, in step S102, the CPU 41 receives BET information transmitted from the station 3 (see step S203 in FIG. 9). The BET information is information relating to BET and includes information indicating whether or not a BET is placed and information indicating the value of the BET.

Next, in step S103, the CPU 41 determines seven cards to be dealt to each of the player and the banker, out of a single set of playing cards, by using random numbers. Here, card images indicative of the seven banker's cards are displayed facing down to the front display 21 included in the gaming apparatus 1 in the effect processing (see FIG. 1A).

Next, in step S104, the CPU 41 transmits to-be-dealt cards information to the station 3. The to-be-dealt cards information includes information indicative of the types of the cards determined to be dealt to the player and the banker (ranks and suits [heart, club, spade, diamond]). The station 3 displays card images indicative of the seven player's cards to the liquid crystal display 10, based on the received to-be-dealt cards information, and accepts an input for dividing the cards into a set of five cards (a high hand) and a set of two cards (a low hand).

Next, in step S105, the CPU 41 receives selection information transmitted from the station 3 (see step S207 in FIG. 9). The selection information is information indicating which cards are selected as the high hand and which cards are selected as the low hand.

Next, in step S106, the CPU 41 executes processing for dividing the cards dealt to the banker into a high hand and a low hand.

Next, in step S107, the CPU 41 executes processing to open card images indicative of the high hand and the low hand determined in step S106. Here, in the effect processing (see FIG. 1A), the card images indicative of the high hand and the low hand determined in step S106 are displayed to the front display 21 with their faces up.

Next, in step S108, the CPU 41 executes processing for determining winning or losing of the game, based on the selection information received in step S105 and the high hand and the low hand determined in step S106. More specifically, the CPU 41 determines which hand is the stronger of the two by comparing the player's low hand with the banker's low hand, in addition to determining which hand is the stronger of the two by comparing the player's high hand with the banker's high hand, and then determines winning or losing of the game based on the determination results. More specifically, when the player's high hand is stronger than the banker's high hand and the player's low hand is stronger than the banker's low hand, the player wins, and when the banker's high hand is stronger than the player's high hand and the banker's low hand is stronger than the player's low hand, the banker wins. When one player's hand, out of the high hand and the low hand, is stronger than the banker's corresponding hand and the other banker's hand is stronger than the player's corresponding hand, the game is tied.

Next, in step S109, the CPU 41 transmits information indicative of the winning or losing of the game determined in step S108 (hereinafter, also referred to as winning/losing information) to the station 3. The station 3, on receiving the winning/losing information, displays a single image describing any one of "you win", "you lose" and "tie" to the liquid crystal display 10, based on the winning/losing information.

Next, in step S110, the CPU 41 transmits BET payout information to the station 3. The BET payout information is information indicative of the value of a credit (currency value) to be paid out for a BET. More specifically, when the player wins, the CPU 41 transmits information indicative of a credit value which is twice the value of the BET, and in the event of a tie, the CPU 41 transmits information indicative of the same credit value as the value of the BET. Also, when the banker wins, the CPU 41 transmits information indicating that the value of a credit to be offered is 0. After executing the processing in step S110, the CPU 41 terminates the main-control-portion-side game processing.

Next, there will be described game processing executed in the station.

FIG. 9 is a flow chart illustrating a subroutine of station-side game processing executed in a station according to the present embodiment.

First, in step S202 in FIG. 9, the CPU 51 provided in the station 3 accepts an input of a BET. This enables the player to input a BET through the touch panel 11 provided in the station 3.

Next, in step S203, the CPU 51 transmits BET information on the inputted BET to the main control portion 40. The main control portion 40, on receiving the BET information, determines cards to be dealt to the player and the banker (see step S103 in FIG. 8).

In step S204, the CPU 51 receives to-be-dealt cards information indicative of the cards to be dealt to the player, from the main control portion 40.

In step S205, the CPU 51 displays card images indicative of the seven player's cards to the dealt-card display portion 83 in the liquid crystal display 10, based on the to-be-dealt cards information received in step S204.

In step S206, the CPU 51 accepts inputs of selections of a high hand and a low hand. This enables the player to determine a high hand and a low hand out of the dealt cards by operating the high-hand determination button 84 and the low-hand determination button 85 through the touch panel 11.

In step S207, the CPU 51 transmits selection information based on the selection of the high hand and the low hand to the main control portion 40. The main control portion 40, on receiving the selection information, executes processing for determining a high hand and a low hand of the banker's cards and then determining the winning or losing of the game (see step S108 in FIG. 8).

In step S208, the CPU 51 receives winning/losing information from the main control portion 40.

Subsequently, the CPU 51 displays an image indicating any one of "you win", "you lose" and "tie" to the dealt-card display portion 83 in the liquid crystal display 10, for a predetermined time period (10 seconds, in the present embodiment), based on the received winning/losing information.

In step S209, the CPU 51 receives BET payout information from the main control portion 40. On receiving the BET payout information, the CPU 51 stores, in the RAM 52, credit data based on the BET payout information.

Next, in step S210, the CPU 51 pays out a credit based on the BET payout information received in step S209. After executing the processing in step S210, the CPU 51 terminates the station-side game processing.

Figure 10:
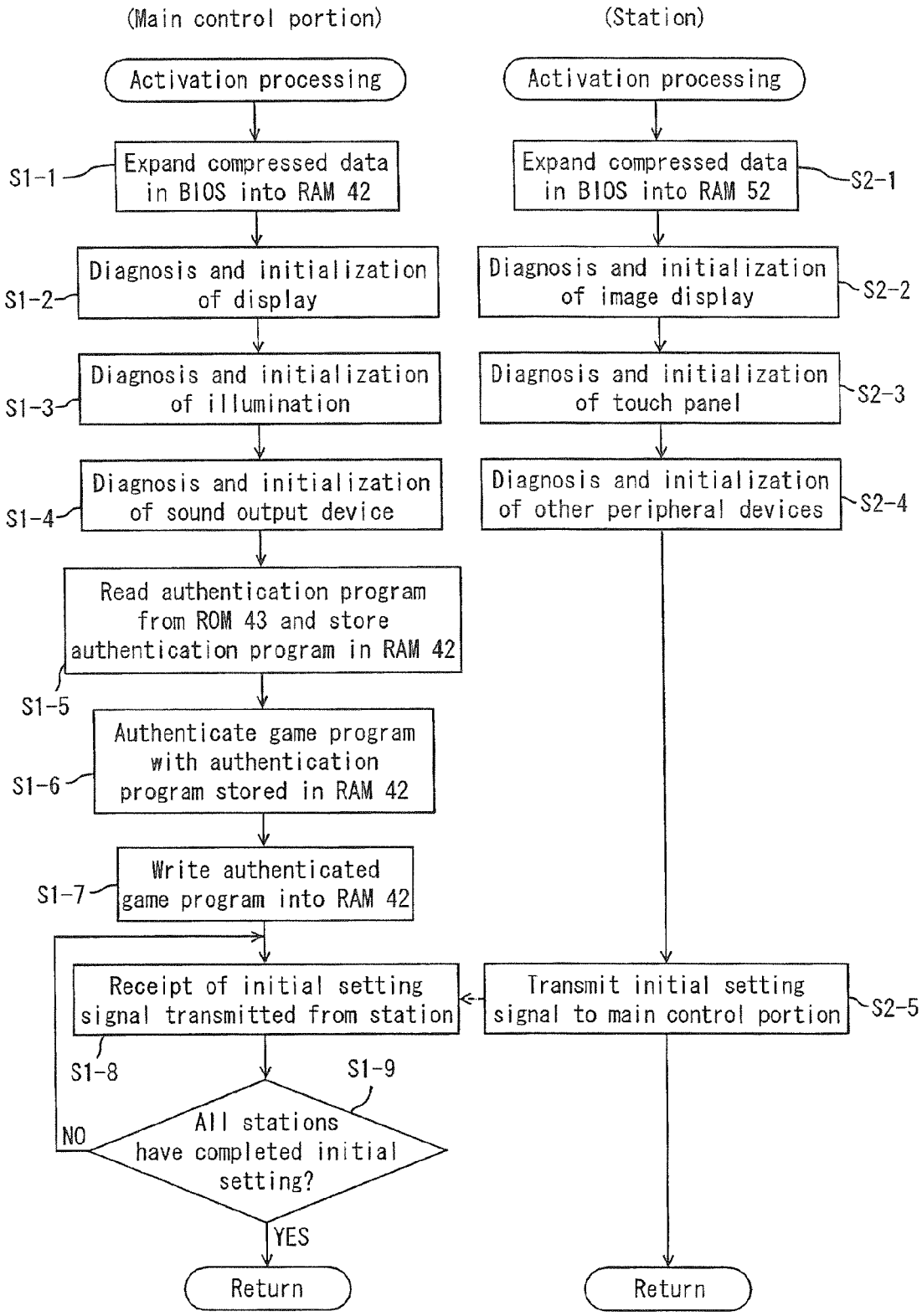
FIG. 10 is a flow chart illustrating a procedure of activation processing.

FIG. 10 is a flow chart illustrating a procedure of activation processing.

This activation processing is processing performed in the main control portion 40 and the station 3 as triggered by switch-on.

When the switch is turned on, first, the CPU 41 of the main control portion 40 executes a BIOS stored in the ROM 43 and expands compressed data, which is incorporated in the BIOS, into the RAM 42 (step S1-1). The CPU 41 then executes the BIOS expanded into the RAM 42, to diagnose and initialize a variety of peripheral devices.

Specifically, the CPU 41 diagnoses and initializes the display (front display 21) (step S1-2). In this processing, the CPU 41 transmits a request signal to the image processing circuit 47 that controls the front display 21, and determines whether or not to have received a predetermined response signal, and also performs clearance of a predetermined storage area, and the like.

Next, the CPU 41 diagnoses and initializes illuminations (LEDs 23) (step S1-3). In this processing, the CPU 41 transmits a request signal to the LED driving circuit that controls the LEDs 23, and determines whether or not to have received a predetermined response signal, and also performs clearance of a predetermined storage area, and the like.

Next, the CPU 41 diagnoses and initializes a sound output device (speakers 22) connected to the CPU 41 (step S1-4). In this processing, the CPU 41 transmits a request signal to the sound circuit 48 that controls the speakers 22, and determines whether or not to have received a predetermined response signal, and also performs clearance of a predetermined storage area, and the like.

Next, the CPU 41 reads an authentication program stored in the ROM 43 and also stores the read authentication program into the RAM 42 (step S1-5). At this time, the CPU 41 obtains a checksum by ADDSUM system (standard checking function) in accordance with the function of the standard BIOS of the BIOS, and stores the authentication program into the RAM 42 while performing processing of checking whether or not the storage is performed without an error.

Next, the CPU 41 reads the game program from the ROM 43. In this case, the CPU 41 reads data constituting the game program by four bytes at a time. Subsequently, the CPU 41 performs authentication for checking and verifying that the read game program is authentic (not broken) in accordance with the authentication program stored in the RAM 42 (step S1-6). When normally completing this authentication processing, the CPU 41 writes and stores the game program having been the subject to be authenticated (program having been authenticated) into the RAM 42 (step S1-7).

Meanwhile, the CPU 51 of the station 3 first executes the BIOS stored in the ROM 53, and expands compressed data, which is incorporated into the BIOS, into the RAM 52 (step S2-1). The CPU 51 then executes the BIOS expanded into the RAM 52, and diagnoses and initializes a variety of peripheral devices.

Specifically, the CPU 51 diagnoses and initializes the liquid crystal display 10 (step S2-2). In this processing, the CPU 51 transmits a request signal to the liquid crystal panel driving circuit 57, and determines whether or not to have received a predetermined response signal.

Next, the CPU 51 diagnoses and initializes the touch panel 11 (step S2-3). In this processing, the CPU 51 transmits a request signal to the touch panel 11, and determines whether or not to have received a predetermined response signal.

Next, the CPU 51 diagnoses and initializes the other peripheral devices connected to the CPU 51 (step S2-4).

Next, the CPU 51 transmits an initial setting signal to the main control portion 40 (step S2-5). The initial setting signal is a signal indicating completion of the diagnosis and initialization of the variety of peripheral devices in the station 3.

After executing the processing of step S2-5, the CPU 51 completes the present subroutine.

The CPU 41 of the main control portion 40 receives the initial setting signal transmitted by the stations 3 in step S2-5 (step S1-8). Subsequently, the CPU 41 determines whether or not to have received the initial setting signals from all the stations 3 (step S1-9).

When determining that the initial setting signal has not been received from a certain station 3, the CPU 41 returns the processing to step S1-8. On the other hand, when determining that the initial setting signals have been received from all the stations 3, the CPU 41 completes the present subroutine.

As above described, according to the gaming apparatus 1 in accordance with the present embodiment and the control method thereof, the dealer image data and the card image data as game image data are read from the ROM 43 according to the progress of the game. Further, the gaming apparatus 1 determines which background image data to read out of a plurality of the background image data, and read the determined background image data from the ROM 43. Then, the gaming apparatus 1 displays to the front display 21 a display image based on display image data in which the dealer image data, the game image data, and the background image data are superimposed one another. On the other hand, a background sound corresponding to the read background image data is outputted from the speakers 22.

Accordingly, in the case of displaying the background image of a waiter passing close behind the dealer, footsteps can be set louder compared to a case of displaying the background image of the waiter passing far behind the dealer. Further, by displaying the background image not relating to the progress of the game directly, it is possible to provide a player with the stronger sense of realism that the player is playing the game in a casino.

Particularly, since the gaming apparatus determines which background image data to read out of the plurality of the background image data, it is possible to provide randomness to the background image to be displayed, resulting in providing the player with the stronger sense of realism.

In the above-described embodiment, there has been described a case where the background effect is selected by using a random number, namely, a case where the background effect is selected randomly. However, the present invention is not limited to this example, and the background effect may be selected according to the progress of the game. This case will be described in the following. Here, except for the background effect determination table, the virtually same configuration as that of the above-described gaming apparatus 1 is provided, and therefore, descriptions thereof will be omitted except for a description of the background effect determination table.

FIG. 11 is a view illustrating a background effect determination table according to another embodiment of the present invention.

As illustrated in FIG. 11, background image data respectively corresponds to background sound data as background effects A to F. Further, selection conditions are respectively set to the background effects. Here, in the background effect determination table, a content of the effect is also written.

Here, specific contents of the background image data and the background sound data may be set as appropriate. In the present embodiment, the same contents as those described in FIG. 1B are used. Accordingly, descriptions thereof are omitted here.

The selection condition is a condition for selecting each background effect. For example, in the case that one pair is established in banker's (dealer's) cards when 7 cards are dealt to the banker in step S103 in FIG. 8, processing to select the background effect corresponding to the selection condition, namely, processing to select the background effect A, is executed, in stead of executing the processing of step S14 in FIG. 1A.

According to the above-described gaming apparatus 1, the background image data corresponding to the progress of the game is read and the background image corresponding to the dealer's hand is displayed. Accordingly, the dealer's hand can be implied to the player, and the background image can be related to the progress of the game, resulting in making the game more profound.

In the above-described embodiment, there have been described a case where the background effect is selected by using a random number and a case where the background effect is selected according to the progress of the game. However, the present invention is not limited to these cases, and a plurality of the background image data stored in the memory (for example, ROM 43) may be read in a predetermined order. In such a configuration, when an audience is displayed as the background image, for example, it is possible to provide a player with the stronger sense of realism by changing the size or the age group of the audience in accordance with the time.

Further, in the present invention, a way of reading the background image data from the memory is not particularly limited. For example, the background image data may be read at random in certain hours and may be read in a predetermined order in different hours.

In the above-described embodiment, there has been described a case where a two-dimensional image is used. However, in the present invention, a three-dimensional image may be used. This case will be described in the following. Here, except for the effect processing, the virtually same configuration as that of the above-described gaming apparatus 1 is provided, and therefore, descriptions thereof will be omitted except for descriptions of the effect processing and three-dimensional image generation processing.

Figure 12:
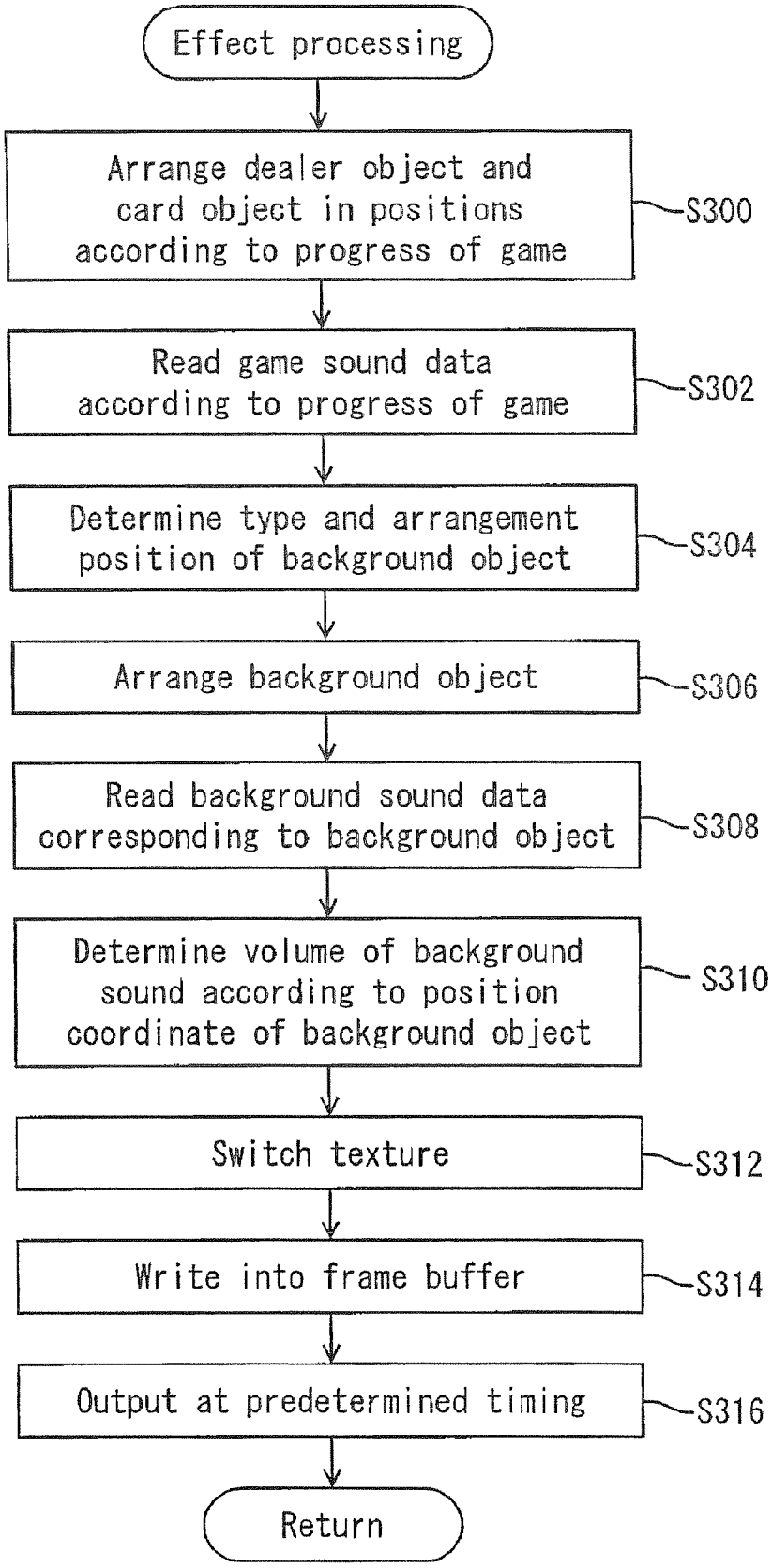
FIG. 12 is a flow chart illustrating effect processing according to another embodiment of the present invention.

FIG. 12 is a flow chart illustrating effect processing according to another embodiment of the present invention.

Here, in the ROM 43 provided in the gaming apparatus 1 of the present embodiment, there is provided an animation data storage area. In the animation data storage area, there are stored a dealer object, a game object and a background object. In data of each object, there are included a global coordinate, a local coordinate, a texture, a camera view position, a camera view angle, and the like.

First, in step S300, the CPU 41 arranges the dealer object and a card object in positions according to the progress of the game. The card object is included in the game object of the present invention. The game object is an object relating to the progress of the game. Examples of the game object include a card object indicating a card, and the like, in the case that the game is a card game as in the present embodiment, and a ball object indicating a ball of roulette, and the like, in the case that the game is a roulette game. For example, when to-be-dealt cards are determined (see step S103 in FIG. 8), the dealer object and the card object are made into predetermined shapes and arranged in predetermined positions in a world coordinate space so as to show a state that the dealer deals cards.

In step S302, the CPU 41 reads game sound data corresponding to the progress of the game from the ROM 43. For example, when cards are opened (see step S107 in FIG. 8), the CPU 41 reads from the ROM 43 the game sound data according to an effect sound at turning up cards.

In step S304, the CPU 41 determines a type and an arrangement position of the background object. Examples of types of the background objects include a waiter object indicating a waiter, a lady customer object indicating a lady customer, a male customer object indicating a male customer, and the like. In the processing, the CPU 41 selects a random number by executing a random number generating program included in the game program so as to determine a single background object and an arrangement position thereof.

In step S306, the CPU 41 arranges the background object determined in step S304 in the determined position in the world coordinate space. Here, the background object is made into a predetermined shape according to the position to be arranged.

In step S308, the CPU 41 reads the background sound data corresponding to the background object. For example, in the case that the waiter object is determined as the background object, the CPU 41 reads data indicating footsteps of the waiter as the background sound data.

In step S310, the CPU 41 determines the volume of the background sound to be outputted, according to the position coordinate of the background object. For example, in the case that the waiter object is determined to be arranged in the position coordinate close to the dealer (close to the player), the volume of the footsteps as the background sound is determined to be louder than the volume of the footsteps in the case that the waiter object is determined to be arranged in the position coordinate far from the dealer (far from the player).

Next, the CPU 41 switches the texture (step S312) and writes the texture into a SDRAM (frame buffer) provided in an image processing circuit 47 (step S314). Then, the CPU 41 outputs three-dimensional image data from the SDRAM (frame buffer) every 1/30 of a second. Consequently, a three-dimensional image is displayed to a front display 21.

In the following, generation processing of the three-dimensional image will be specifically described.

Figure 13:
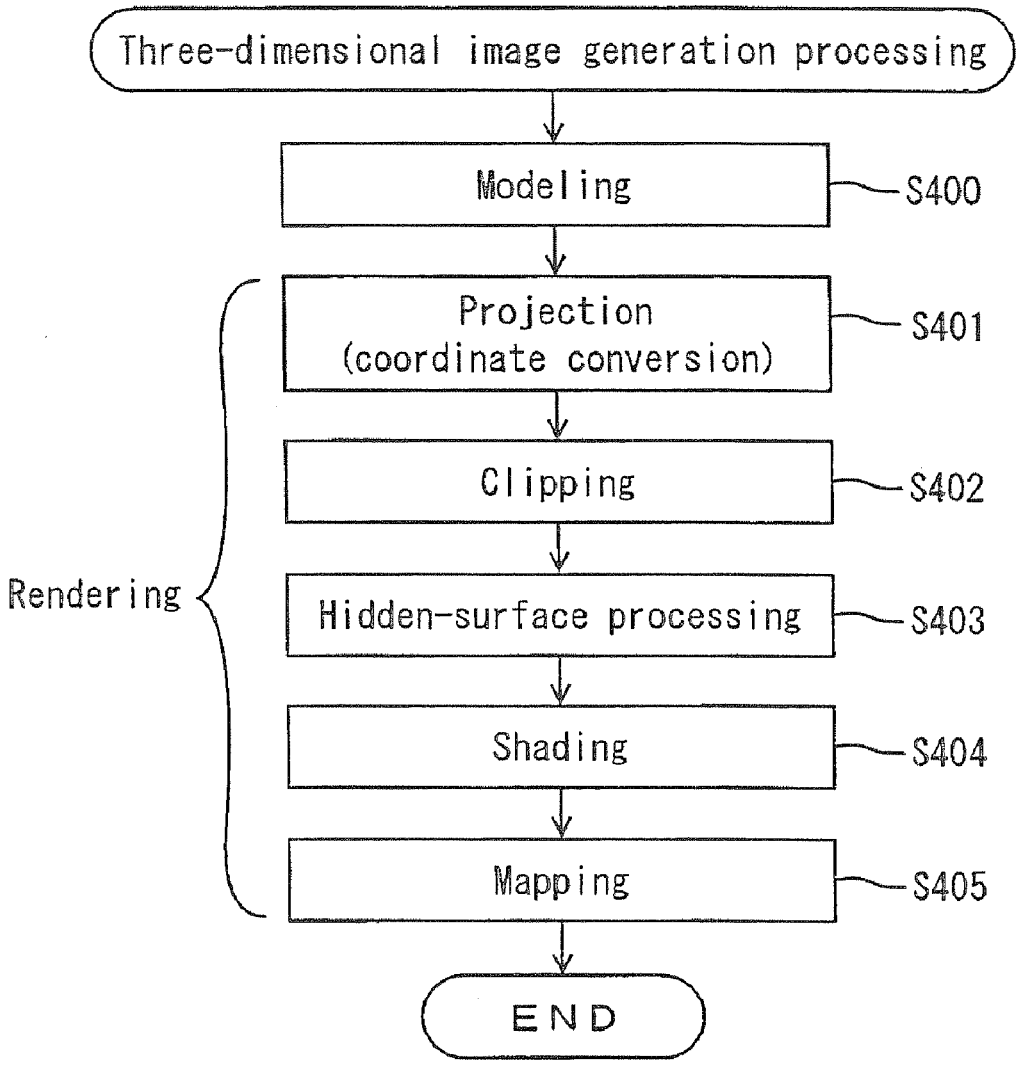
FIG. 13 is a flow chart illustrating a subroutine of three-dimensional image generation processing executed in the main control portion according to another embodiment of the present invention.

FIG. 13 is a flow chart illustrating a subroutine of three-dimensional image generation processing executed in the main control portion according to another embodiment of the present invention.

The processing corresponds to step S300 to step S306 and step 312 to step 316 of the subroutine illustrated in FIG. 12. The processing is executed when three-dimensional image data in a single frame is generated. Accordingly, it becomes possible to display video comprising three-dimensional images by executing the processing illustrated in FIG. 13 repeatedly. Further, following processing is processing executed by the CPU 41 and a rendering processor (not illustrated) provided in the image processing circuit 47, which are interconnected through a bus. Namely, the CPU 41 executes modeling and texture mapping of the object. On the other hand, the rendering processor executes rendering according to a direction (command) from the CPU 41, and also executes pixel drawing. Here, data and a program required for the task executed by the rendering processor are expanded in the SDRAM (not illustrated) provided in the image processing circuit 47 on activation.

In the processing illustrated in FIG. 13, an object stored in the animation data storage area of the ROM 43 is read, based on the data determined in step S300 and in step S304 in FIG. 12, and modeling of the object (dealer object, card object, background object) to be arranged in the world coordinate space is executed (step S400).

In the processing, a sub CPU 206 arranges each object in the world coordinate space, in addition to determining a shape of each object. Here, the shape of each object is represented in the local coordinate system which is set for each object. Further, each of the modeled objects is arranged in the world coordinate space.

Next, rendering is executed in later-described steps S401 to S405.

First, projection (coordinate conversion) is executed (step S401), and subsequently, clipping is executed (step S402) The processing will be described with reference to FIG. 14.

Figure 14:
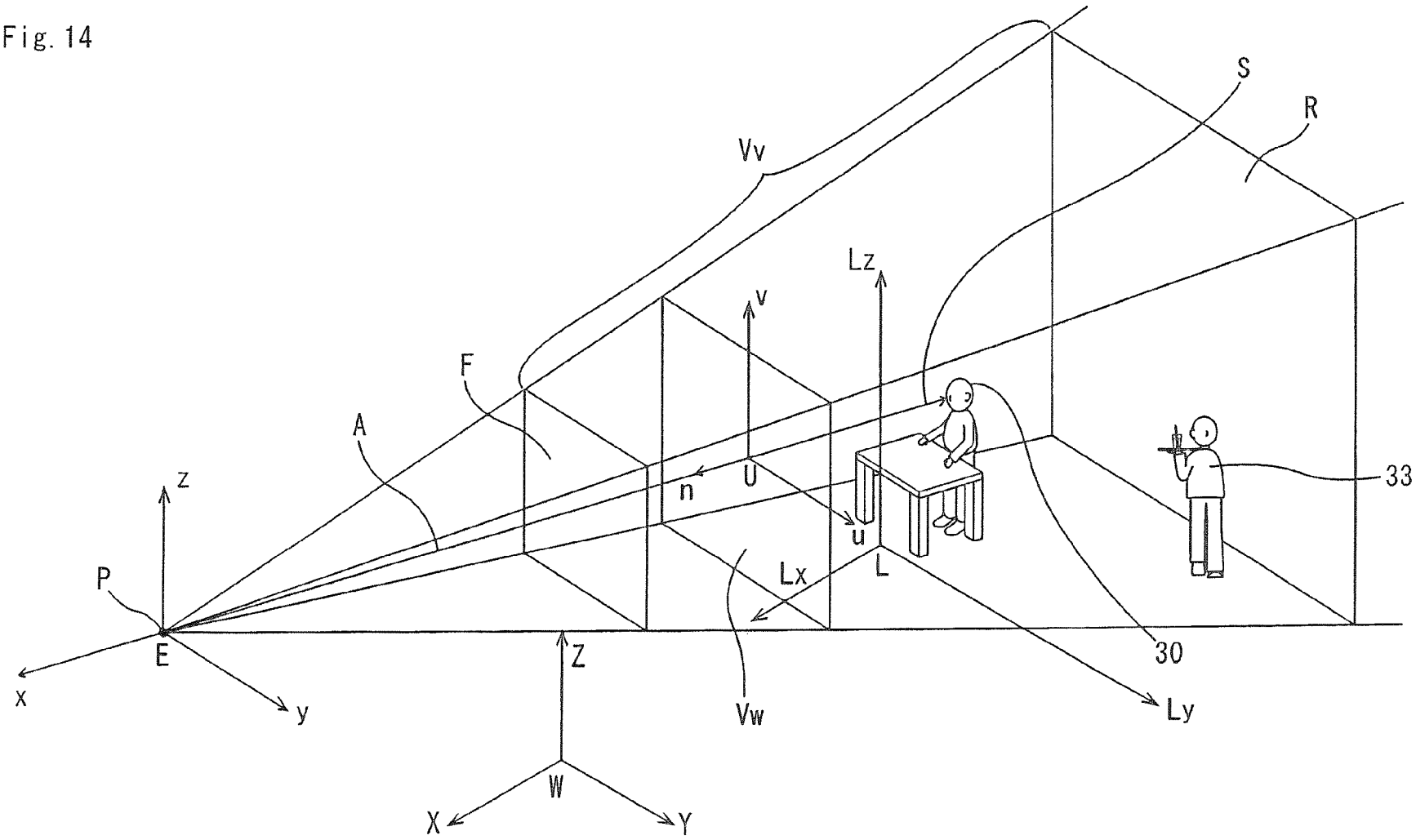
FIG. 14 is a perspective view schematically illustrating an example of a world coordinate space.

FIG. 14 is a perspective view schematically illustrating an example of a world coordinate space.

In a world coordinate space W (X, Y, Z), each of the above-described objects are arranged. In the figure, a part of the objects is omitted to facilitate the description.

A dealer object 30 is represented in a local coordinate space L (Lx, Ly, Lz). A vision coordinate system E (x, y, z) is a coordinate system for setting a view point P, a visual axis A, and a focus point S. Here, the focus point S is set on a center part of the dealer object 30.

A uvn coordinate system U (u, v, n) is a coordinate system for setting a view window. A n-axis is coincident with a x-axis in the vision coordinate system and a uv plane becomes a view window Vw. In the figure, Vv indicates view volume. Further, F indicates a near clip plane. Furthermore, R indicates a far clip plane.

In step S401, each object is arranged in the world coordinate space by converting the local coordinate of each object to the world coordinate, and the view point P, the visual axis A, and the focus point S are set. Further, in step S402, the uvn coordinate system U is set and the object not included in the view volume Vv is deleted.

Next, hidden surface processing is executed (step S403) so as to delete the surface invisible from the view point. Then, shading is executed (step S404) so as to set brightness of each pixel. Further, mapping of the texture is executed (step S405) and the present subroutine is terminated.

In the gaming apparatus 1, an environment of the world coordinate space is changed for each execution of the unit processing (processing illustrated in FIG. 13). Examples of the environment include an arrangement position and a shape of each object. The change of the environment enables display of video comprising three-dimensional images. Here, in the present embodiment, the position of the view point and the focus point (visual axis) are fixed, however, these may be changed in the present invention.

According to the gaming apparatus 1, the volume of the background sound may be related to the position of the background object (for example, waiter object). Namely, for example, in the case that the background object is the object showing a waiter, the volume and echoes of footsteps of the waiter can be changed in a case where the waiter passes close behind the dealer and in a case where the waiter passes far behind the dealer, resulting in making the game more realistic. Further, by displaying the background image not relating to the progress of the game directly, it is possible to provide a player with the stronger sense of realism that the player is playing the game in a casino.

Although the present invention has been described with reference to embodiments thereof, these embodiments merely illustrate concrete examples, not restrict the present invention. The concrete structures of respective means and the like can be designed and changed as required. Furthermore, there have been merely described most preferable effects of the present invention, as the effects of the present invention, in the embodiments of the present invention. The effects of the present invention are not limited to those described in the embodiments of the present invention.

Further, in the aforementioned detailed description, characteristic portions have been mainly described, for ease of understanding the present invention. The present invention is not limited to the embodiments described in the aforementioned detailed description, but can be also applied to other embodiments over a wider range of applications. Further, the terms and phrases used in the present specification have been used for clearly describing the present invention, not for limiting the interpretation of the present invention. Further, those skilled in the art will easily conceive other structures, systems, methods and the like which are included in the concept of the present invention, from the concept of the present invention described in the present specification. Accordingly, the description of the claims is intended to include equivalent structures that fall within the technical scope of the invention. Further, the abstract aims at enabling engineers and the like who belong to the present technical field but are not familiar with the patent office and public institutions, the patent, law terms and technical terms to immediately understand the technical content and the essence of the present application through brief studies. Accordingly, the abstract is not intended to restrict the scope of the invention which should be evaluated from the description of the claims. It is desirable that literatures and the like which have been already disclosed are sufficiently studied and understood, in order to sufficiently understand the objects of the present invention and the specific effects of the present invention.

In the aforementioned detailed description, there have been described processes to be executed by computers. The aforementioned description and expressions have been described for the sake of enabling those skilled in the art to understand the present invention most effectively. In the present specification, each step for deriving a single result should be understood to be self-consistent processing. Further, each step includes transmission, reception, recording and the like of electric or magnetic signals. Although, in the processing at each step, such signals have been expressed as bits, values, symbols, characters, terms, numerical characters and the like, it should be noticed that they have been merely used for convenience of description. Further, although the processing at each step was described using expressions common to human behaviors in some cases, the processes described in the present specification are to be executed by various types of devices, in principle. Further, other structures required for executing each step will be apparent from the aforementioned description.

What is claimed as new and desired to be secured by Letters Patent of the United States is:

1. A gaming apparatus comprising:

a display;

a speaker;

a memory storing dealer image data for displaying a dealer who advances a game, game image data relating to a progress of the game, and background image data corresponding to background sound data for outputting a background sound; and a controller, said controller programmed to execute the processing of (A) advancing a game, (B) reading the dealer image data and the game image data from said memory according to the progress of the game in said processing (A), (C) selecting, from the background image data stored in said memory, selected background image data to be read from said memory, wherein the selection is made randomly during a first time period, and is made according to a predetermined order during a second time period, (D) reading from said memory the selected background image data selected in said processing (C), (E) displaying to said display a display image based on display image data, after generating the display image data by superimposing the dealer image data and the game image data read in said processing (B) on the selected background image data read in said processing (D), and (F) outputting from said speaker the background sound based on the background sound data, after reading, among sets of background sound data which correspond to the plurality of the background image data, respectively, the background sound data corresponding to the selected background image data read in said processing (D).

2. The gaming apparatus of claim 1, wherein:

the selected background image data is image data of a person passing by the dealer; and the background sound output from the speaker has a volume that depends on an apparent distance between the dealer and the person passing by the dealer.

3. The gaming apparatus of claim 1, wherein:

the selected background image data is image data of a person passing by the dealer; and the background sound output from the speaker comprises a sound of footsteps and a sound of an echo of the footsteps.

4. The gaming apparatus of claim 1, wherein the selected background image data is an image that is not related to the game.

5. The gaming apparatus of claim 1, wherein:

the selected background image data is image data of an audience; and the audience has a size that varies with time.

6. The gaming apparatus of claim 1, wherein:

the selected background image data is image data of an audience; and the audience has an age group that varies with time.

7. A method executed by a gaming apparatus, said method comprising:

(A) the gaming apparatus advancing a game, (B) the gaming apparatus reading dealer image data for displaying a dealer who advances a game and game image data relating to a progress of the game from a memory of the gaming apparatus, according to the progress of the game in (A), (C) the gaming apparatus determining which background image data to read from a plurality of background image data stored in said memory, wherein the determination is made randomly during a first time period, and is made according to a predetermined order during a second time period, (D) the gaming apparatus reading from said memory the background image data determined in (C), (E) the gaming apparatus displaying to a display a display image based on display image data, after generating the display image data by superimposing the dealer image data and the game image data read in (B) on the background image data read in (D), and (F) the gaming apparatus outputting from a speaker a background sound based on background sound data, after reading, among sets of background sound data which correspond to the plurality of the background image data, respectively, the background sound data corresponding to the background image data read in (D).

8. The method of claim 7, wherein:

the background image data determined in (C) is image data of a person passing by the dealer; and the background sound output from the speaker has a volume that depends on an apparent distance between the dealer and the person passing by the dealer.

9. The method of claim 7, wherein:

the background image data determined in (C) is image data of a person passing by the dealer; and the background sound output from the speaker comprises a sound of footsteps and a sound of an echo of the footsteps.

10. The method of claim 7, wherein the background image data determined in (C) is an image that is not related to the game.

11. The method of claim 7, wherein:

the background image data determined in (C) is image data of an audience; and the audience has a size that varies with time.

12. The method of claim 7, wherein:

the background image data determined in (C) is image data of an audience; and the audience has an age group that varies with time.

* * * * *